US005941690A

United States Patent [19]

Lin

[11] Patent Number: 5,941,690

[45] Date of Patent: Aug. 24, 1999

[54] CONSTANT PRESSURE VARIABLE SPEED INVERTER CONTROL BOOSTER PUMP SYSTEM

[76] Inventor: Yung-Te Lin, P.O. Box 82-144, Taipei, Taiwan

[21] Appl. No.: 08/773,530

[22] Filed: Dec. 23, 1996

[51] Int. Cl.[6] ..... F04B 49/06

[52] U.S. Cl. ..... 417/44.2; 417/45

[58] Field of Search ..... 417/38, 25, 26, 417/18, 44.1, 45, 44.2, 44.4, 44.3, 44.11

[56] References Cited

U.S. PATENT DOCUMENTS

| | | | |
|---|---|---|---|
| 3,775,025 | 11/1973 | Maher, Jr. et al. | 417/7 |
| 4,165,951 | 8/1979 | Friedman et al. | 417/26 |
| 4,290,735 | 9/1981 | Sulko | 417/2 |
| 5,221,189 | 6/1993 | Henningsen | 417/18 |
| 5,281,101 | 1/1994 | Bevington | 417/38 |
| 5,580,221 | 12/1996 | Triezenberg | 417/44.2 |

*Primary Examiner*—Timothy Thorpe
*Assistant Examiner*—Xuan M. Thai

[57] ABSTRACT

A constant pressure variable speed inverter control booster pump system including a control unit, an inverter controlled by the control unit to change output frequency subject to the pressure of the water supply pipe, a motor controlled by the inverter to drive a pump, a pressure transmitter installed to detect the pressure in the water supply pipe, and a pump controlled by the motor to pump water through the water supply pipe, wherein the control unit detects the change of pressure in the water supply pipe, and provides an analog signal DC 0V–10V to the inverter subject to the detection result, causing the inverter to change output frequency to the motor, so as to control the speed of the motor under a constant range.

1 Claim, 4 Drawing Sheets

CONSTANT PRESSURE VARIABLE SPEED INVERTER CONTROL BOOSTER PUMP SYSTEM

BACKGROUND OF THE INVENTION

1. Field of the Invention

This invention relates to booster pump systems, and more particularly to a booster pump with constant pressure controller which automatically detects the pressure of the water supply pipe, and changes the speed of the motor subject to the pressure detected.

2. Description of the Prior Art

A variety of booster pump systems have been developed, and intensively used in high-rise buildings for pumping water from a water supply pipe system under the ground to a water reservoir on the roof. These booster pump systems are commonly controlled by a pressure switch. When the pressure in the supply line drops below the preset level, the motor starts to drive the pump. On the contrary, when the pressure surpasses the preset level, the motor stops. Because the pressure switch is frequently turned on and off, the switching contact tends to be fused.

Another drawback of these conventional booster pump systems is that the pressure of water changes sharply during the operation of motor, thereby causing the hot water can't be supplied under a steady condition when in a shower. Still another drawback of these conventional booster pump systems is their high consumption of electric power, because the consumption of energy is directly proportional to the starting frequency of the motor. When the pressure of water drops below the preset level, the motor will immediately turn on at full speed. Therefore, much power supply is consumed during the operation of the system.

There is known an inverter controlled booster pump which, as shown in FIG. 1, is comprised of a pressure meter, a pressure transmitter, a PID (Proportion Integral Differential), an inverter, and a pump. The PID controls the inverter to change output frequency to the pump subject to the pressure of the water supply pipe detected by the pressure transmitter, causing the speed of the pump to be regulated. However, this structure of inverter controlled booster pump system is expensive to manufacture. Furthermore, the operation of this inverter controlled booster pump system tends to be interfered with external magnetic waves because the pressure meter, the pressure transmitter, and the PID are separately installed.

SUMMARY OF THE INVENTION

This invention relates to booster pump systems, and more particularly to a constant pressure variable speed inverter control booster pump system which automatically detects the pressure of the water supply pipe, and changes the speed of the motor subject to the pressure detected.

There are several outstanding qualities of the present invention: enable the pump system consume less energy; the system may start under the rated range; maintain a constant pressure in the supply line; prolong the service life of the motor; easy to be installed; accurately control the speed of the motor subject to the pressure of the supply line without being affected by external magnetic waves; pressure reading in digital display (only ±1% away from the actual figure showed on the meter); when the water is not in use, motor will stop automatically, an automate-alternate parallel operation enable the motors shift smoothly. According to the preferred embodiment of the present invention, the constant pressure variable speed inverter control booster pump system comprises a control unit, an inverter controlled by the control unit to change output frequency subject to the pressure of the water supply pipe. The motor controlled by the inverter to drive a pump to pump water through the water supply pipe, wherein the control unit detects the change of pressure, and provides an analog signal DC 0V–10V to the inverter subject to the detection result, causing the inverter to change output frequency to the motor, so as to control the speed of the motor under a constant range. The pressure control unit is protected within a stainless steel container, and the container is connected to the zero potential of the internal circuit of the pressure control unit. Therefore, external interference waves are eliminated.

DETAILED DESCRIPTION OF THE PREFERRED EMBODIMENT

Figure 1:
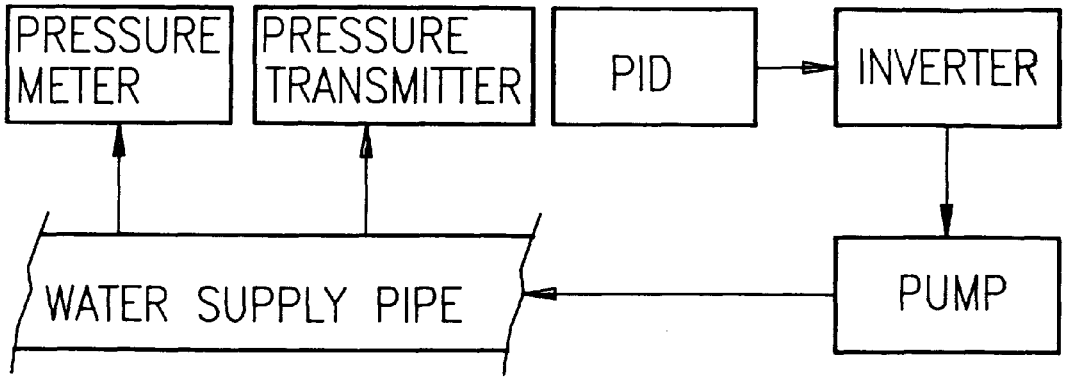
FIG. 1 is a block diagram of a pressure-controlled booster pump system according to the prior art.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
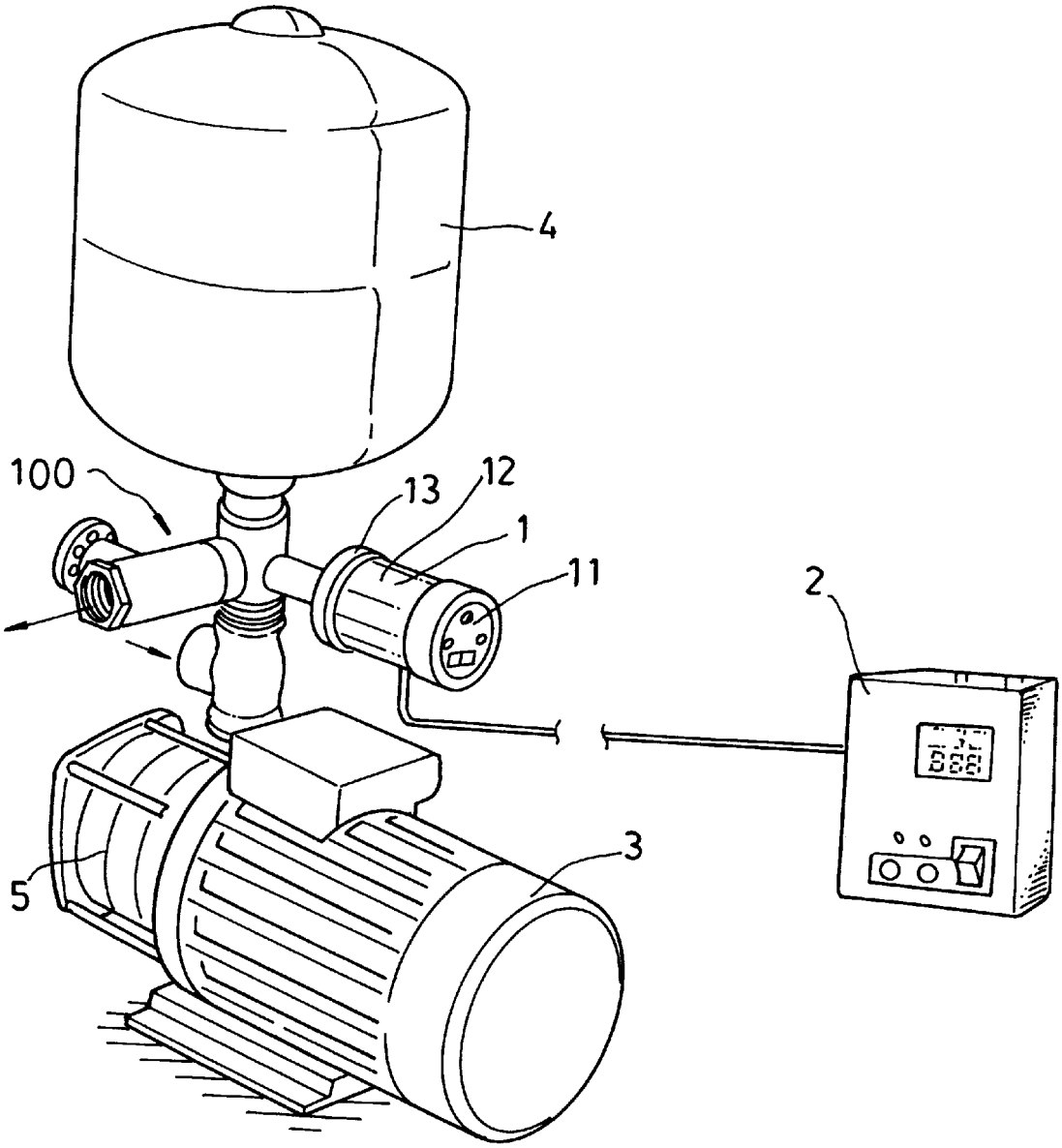
FIG. 2 is an elevational view of a constant pressure variable speed inverter control booster pump system according to the present invention.

Referring to FIG. 2, a variable speed drive booster pump system in accordance with the present invention, is generally comprised of a control unit 1, an inverter 2, a motor 3, a pressure tank 4, and a pump 5. The control unit 1 is a microprocessor protected within a stainless steel container, providing the functions of monitoring pressure, indicating monitored pressure, and controlling the pressure. The control unit 1 monitors the pressure of water in the water supply pipe 100, and then sends an analog signal DC 0V–10V to the inverter 2 subject to the value of the pressure monitored, causing the inverter 2 to change the frequency of power supply to the motor 3 and the pump 5, and therefore the motor 3 and the pump 5 are controlled under a constant speed.

Figure 3:
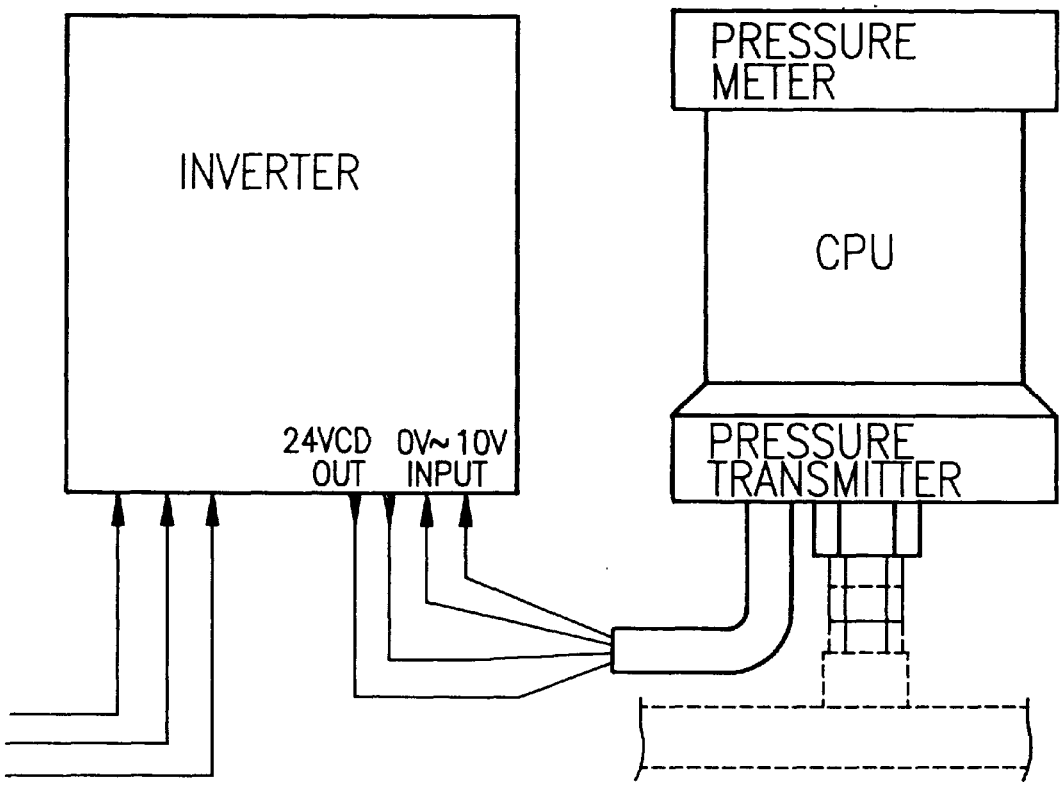
FIG. 3 shows the structure of the control unit, and the relationship between the control unit and the inverter.

Referring to FIG. 3, an analog signal DC 0V–10V which was obtained from the water supply pipe 100 through the control unit 1 is sent to the inverter 2 by conductors. The control unit 1 comprises a pressure meter 11, a CPU 12, and a pressure transmitter 13. The CPU detects and controls the pressure, and detects the leakage of water. The pressure meter 11 is controlled by the CPU 12 to show the value of the pressure monitored by the CPU 12. The pressure transmitter 13 is controlled by the CPU 12 to control the inverter 2 in changing the frequency of power supply.

Figure 4:
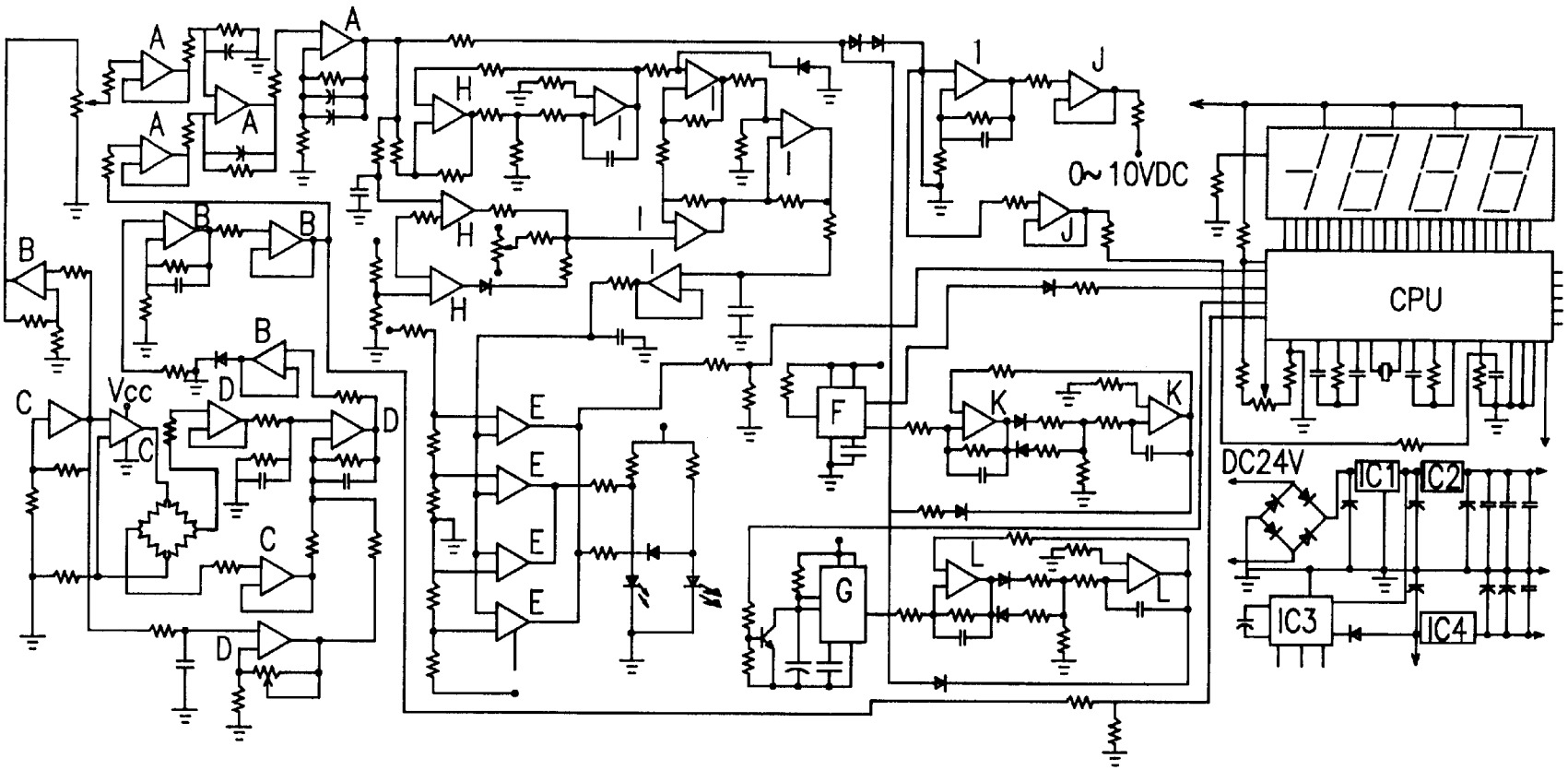
FIG. 4 is a circuit diagram of the 3-in-1 constant pressure controller.

Referring to FIG. 4, IC(C) is a constant voltage, constant current power supply circuit that provides stabilized power supply to a pressure detecting chip and a pressure setting control; IC(D) and IC(B) form a filter amplifier that expels waves induced by the pulse of water pressure, and amplifies filtered signal, so that the volume of the external pressure accumulator can be greatly minimized and, a constant power supply output can be achieved; IC(A) and IC(C) form a pressure controller, which compares the pressure of the water supply pipe obtained from the pressure transmitter, with the pressure set through the pressure setting control, permitting the comparison result to be amplified by a differential buffer amplifier and processed through buffers, so as to provide a DC 0V–10V control signal for driving the inverter; IC(H) and IC(I) form a pipe detecting circuit, that detects the presence of water and the leakage of water in the water supply pipe, and provides a reference voltage signal to a window comparator for comparison when there is no water in the water supply pipe, or when there is a water leakage in the water supply pipe; IC(E) is a window comparator that compares the reference voltage signal of the pipe detecting circuit with the set value, and provides a signal to the CPU for judgement if the comparison result surpasses/or is below the preset pressure simultaneously drives a bi-color LED; IC(F) and IC(K) form a speed regulating circuit for a first stage speed drop buffering, which is controlled by the CPU to buffer the dropping of speed when the CPU detects the water is not in use; IC(G) and IC(L) form a stop buffering control circuit for a second stage stop buffering, which is controlled by the CPU to stop the system in 20 seconds after the speed regulating circuit has been controlled by the CPU to drop the speed, when there isn't any pressure change in the water supply pipe during this period, or to boost the speed rapidly if there is a pressure change in the water supply pipe during this period; CPU is a CMOS (complementary metal-oxide semiconductor) chip for analog-digital conversion, multiple set I/O pressure indication, and internal function determination.

Figure 5:
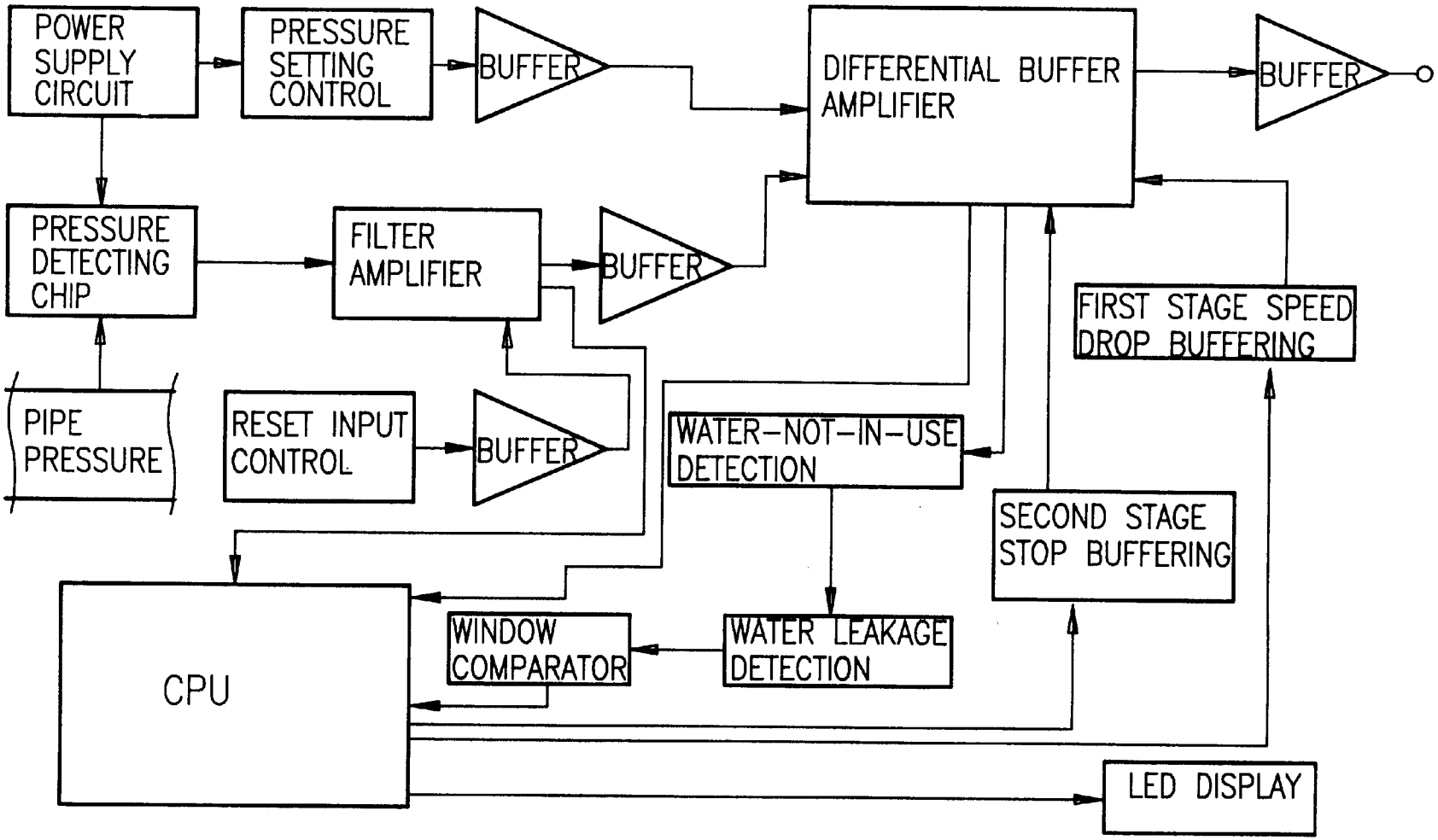
FIG. 5 is a block diagram showing the operation diagram of the present invention.

FIG. 5 shows the operation diagram of the present invention. The controller 1 detects the change of pressure in the water supply pipe through the pressure transmitter, then converts the change of pressure into a corresponding voltage signal, and then sends the voltage signal to the inverter 2, causing it to regulate the speed of the pump 5, and therefore the speed of the pump 5 is controlled under a constant range.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A constant pressure variable speed inverter control booster pump system comprising:

a constant pressure control system: combine pressure meter, pressure transmitter and CPU in one, installed in a stainless steel container, said CPU being a complementary metal-oxide semiconductor chip for analog-digital conversion, multiple set I/O pressure indication, and internal function determination, a pressure transmitter that detects the pressure of a water supply pipe, a filter amplifier that removes waves from said pressure sensor induced by the pulse of water pressure and amplifies filtered signal, a water supply pipe detecting circuit that detects the presence of water and a leakage of water in said water supply pipe, and provides a reference voltage signal to a window comparator for comparison when the water is not in use, or when there is a water leakage, a window comparator that compares the reference voltage signal of said pipe detecting circuit with a set value, and provides a signal to said CPU for judgement if the comparison result surpasses/or is below the preset pressure simultaneously drives a bi-color LED, a speed regulating circuit controlled by said CPU to buffer the dropping of speed of the system when said CPU detects the water is not in use, a stop buffering control circuit controlled by said CPU to stop the system a predetermined length of time after said speed regulating circuit has been controlled by said CPU to drop the speed of the system, when there is not any pressure change in said water supply pipe during this period, or to boost the speed rapidly if there is a pressure change in said water supply pipe during this period, and a power supply stabilizer that provides the system with stabilized power supply;

an inverter controlled by said control unit to change output frequency;

a motor controlled by said inverter to drive a pump;

a pressure transmitter installed in said water supply pipe; and a pump controlled by said motor to pump water through said water supply pipe;

wherein said control unit detects the change of pressure in said water supply pipe, and provides an analog signal DC 0V–10V to said inverter subject to the detection result, causing said inverter to change output frequency to said motor, so as to control the speed of said motor under a constant range.

* * * * *